US008393019B1

(12) United States Patent
Cavuoti

(10) Patent No.: US 8,393,019 B1
(45) Date of Patent: Mar. 12, 2013

(54) SPA SYSTEM WITH SEPARATE HOT AND COLD RESERVOIRS

(76) Inventor: Victor V. Cavuoti, Toronto (CA)

( * ) Notice: Subject to any disclaimer, the term of this patent is extended or adjusted under 35 U.S.C. 154(b) by 0 days.

(21) Appl. No.: 13/086,873

(22) Filed: Apr. 14, 2011

(51) Int. Cl.
*A47K 3/00* (2006.01)

(52) U.S. Cl. ..... 4/541.1; 4/541.3; 4/622; 4/546

(58) Field of Classification Search ..... 4/541.3, 4/541.1, 622, 546, 626; 601/166; 607/86, 607/108
See application file for complete search history.

(56) References Cited

U.S. PATENT DOCUMENTS 3,272,201 A * 9/1966 Burns ..... 601/166
3,366,110 A * 1/1968 Gaylord, Jr. ..... 604/290
3,565,065 A 2/1971 Briggs, Jr. et al.
4,217,892 A 8/1980 Brill
4,761,838 A * 8/1988 Hargrove ..... 4/541.2
5,241,958 A * 9/1993 Noeldner ..... 607/86
6,405,390 B2 6/2002 Kuen
6,438,768 B1 8/2002 Yen

* cited by examiner

*Primary Examiner* — Gregory Huson
*Assistant Examiner* — Lauren Heitzer

(57) ABSTRACT

A spa system featuring an immersion tank for holding a therapeutic liquid, the immersion tank may feature multiple sectors, a hot reservoir, a cold reservoir, and a mixer reservoir. The mixer reservoir is fluidly connected to each the hot reservoir, the cold reservoir, and the immersion tank via pipes. The hot reservoir has a heating element, and the cold reservoir has a cooling element. Pipes and pumps connect the immersion tank to the mixer reservoir and to the hot and cold reservoirs and the hot and cold reservoirs to the mixer reservoir. Temperature sensors are disposed in the immersion tank and the mixer reservoir. A control unit having a microprocessor functions to change temperature of the therapeutic liquid in the immersion tank by activating various pumps such that the temperature of the immersion tank matches a pre-programmed temperature.

1 Claim, 6 Drawing Sheets

SPA SYSTEM WITH SEPARATE HOT AND COLD RESERVOIRS

FIELD OF THE INVENTION

The present invention is directed to a bath or spa, more particularly to a spa system with two separate hot and cold liquid reservoirs.

BACKGROUND OF THE INVENTION

Oftentimes hot packs and cold packs as used to help soothe an individual's aches and pains. Or, massaging of the head, shoulders, feet, and other areas may be used (or hydrotherapy, massage of the lymph nodes, etc.). The present invention features a spa system for soothing an individual's feet, arms, head, shoulders, or other (and all) parts of his/her body (e.g., an "arm spa," a "foot spa," a "shoulder spa," etc.). The system of the present invention has a dual temperature feature, allowing both hot and cold therapy to be applied at the same time. In some embodiments, a user can instantly change from hot to cold with the present invention. In some embodiments, a user can have one foot with varying hot temperatures and one foot with varying cold temperatures. In some embodiments, the maximum temperature of the system is about 105 degrees F. In some embodiments, the minimum temperature of the system is about 65 degrees F.

The system of the present invention helps promote health in all individuals including children and adults, particularly in senior citizens. In some embodiments, the system helps remove body toxins, improve circulation, remove toe fungus, relieve arthritis, soften skin, increase energy levels, improve liver and kidney functions, relieve stress, activate the immune system, help inflammatory conditions, help blood circulation in extremities, help with stiffness, sciatica, lumbago, and/or help with high blood pressure.

Any feature or combination of features described herein are included within the scope of the present invention provided that the features included in any such combination are not mutually inconsistent as will be apparent from the context, this specification, and the knowledge of one of ordinary skill in the art. Additional advantages and aspects of the present invention are apparent in the following detailed description and claims.

SUMMARY

The present invention features a spa system. In some embodiments, the spa system comprises an immersion tank for holding a therapeutic liquid; a hot reservoir, a cold reservoir, and a mixer reservoir, the mixer reservoir is fluidly connected to each the hot reservoir, the cold reservoir, and the immersion tank, the reservoirs are each adapted to hold the therapeutic liquid; a heating element disposed in the hot reservoir, the heating element functions to heat the therapeutic liquid in the hot reservoir; a cooling element disposed in the cold reservoir, the cooling element functions to cool the therapeutic liquid in the cold reservoir; a first pipe fluidly connecting the immersion tank to the mixer reservoir, a second pipe fluidly connecting the cold reservoir to the mixer reservoir, a third pipe fluidly connecting the hot reservoir to the mixer reservoir, a fourth pipe fluidly connecting the immersion tank to the cold reservoir, and a fifth pipe fluidly connecting the immersion tank to the hot reservoir; a first pump disposed in the first pipe functioning to deliver liquid from the mixer reservoir to the immersion tank, a second pump disposed in the second pipe functioning to deliver liquid from the cold reservoir to the mixer reservoir, a third pump disposed in the third pipe functioning to deliver liquid from the hot reservoir to the mixer reservoir, a fourth pump disposed in the fourth pipe functioning to deliver liquid from the immersion tank to the cold reservoir, and a fifth pump disposed in the fifth pipe functioning to deliver liquid from the immersion tank to the hot reservoir; a first temperature sensor disposed in the immersion tank, and a second temperature sensor is disposed in the mixer reservoir, the temperature sensors are adapted to detect temperature of the therapeutic liquid; and a control unit having a microprocessor, the control unit functions to change temperature of the therapeutic liquid in the immersion tank, the microprocessor is operatively connected to each the first pump, the second pump, the third pump, the fourth pump, the fifth pump, the first temperature sensor, and the second temperature sensor, the temperature sensors constantly relay an actual temperature of the immersion tank and an actual temperature of the mixer reservoir to the microprocessor, the microprocessor is adapted to store a pre-programmed temperature of the immersion tank and compare the pre-programmed temperature of the immersion tank to the actual temperature of the immersion tank, when the microprocessor detects a difference between the pre-programmed temperature and actual temperature in the immersion tank the microprocessor sends an output signal to the first pump, the second pump, the third pump, the fourth pump, the fifth pump, or a combination thereof to pump either therapeutic liquid into the mixer reservoir whereupon therapeutic liquid from the mixer reservoir is fed into the immersion tank until the immersion tank reaches the pre-programmed temperature.

In some embodiments, the therapeutic liquid comprises water, salt, mud, an herbal solution, deodorant, an aromatic substance, or a combination thereof. In some embodiments, the immersion tank is divided into a first sector and a second sector, wherein the first sector and second sector can have therapeutic liquid at different temperatures. In some embodiments, the hot reservoir and the cold reservoir are each fluidly connected to the immersion tank. In some embodiments, an agitator is disposed in the mixer reservoir, the agitator functions to mix the therapeutic liquid in the mixer reservoir. In some embodiments, the agitator is operatively connected to a motor, the motor functions to drive the agitator. In some embodiments, the control unit comprises a programming box allowing for programming of temperature of the therapeutic liquid in immersion tank. In some embodiments, the microprocessor can be programmed such that at a pre-set time temperature of the therapeutic liquid in the immersion tank temperature will cycle from an ambient temperature to a pre-set maximum hot temperature then to a pre-set maximum cold temperature until the cycle is terminated. In some embodiments, a manual switch is also incorporated to accommodate longer time frames for the hot or the cold temperature.

DESCRIPTION OF PREFERRED EMBODIMENTS

Figure 4:
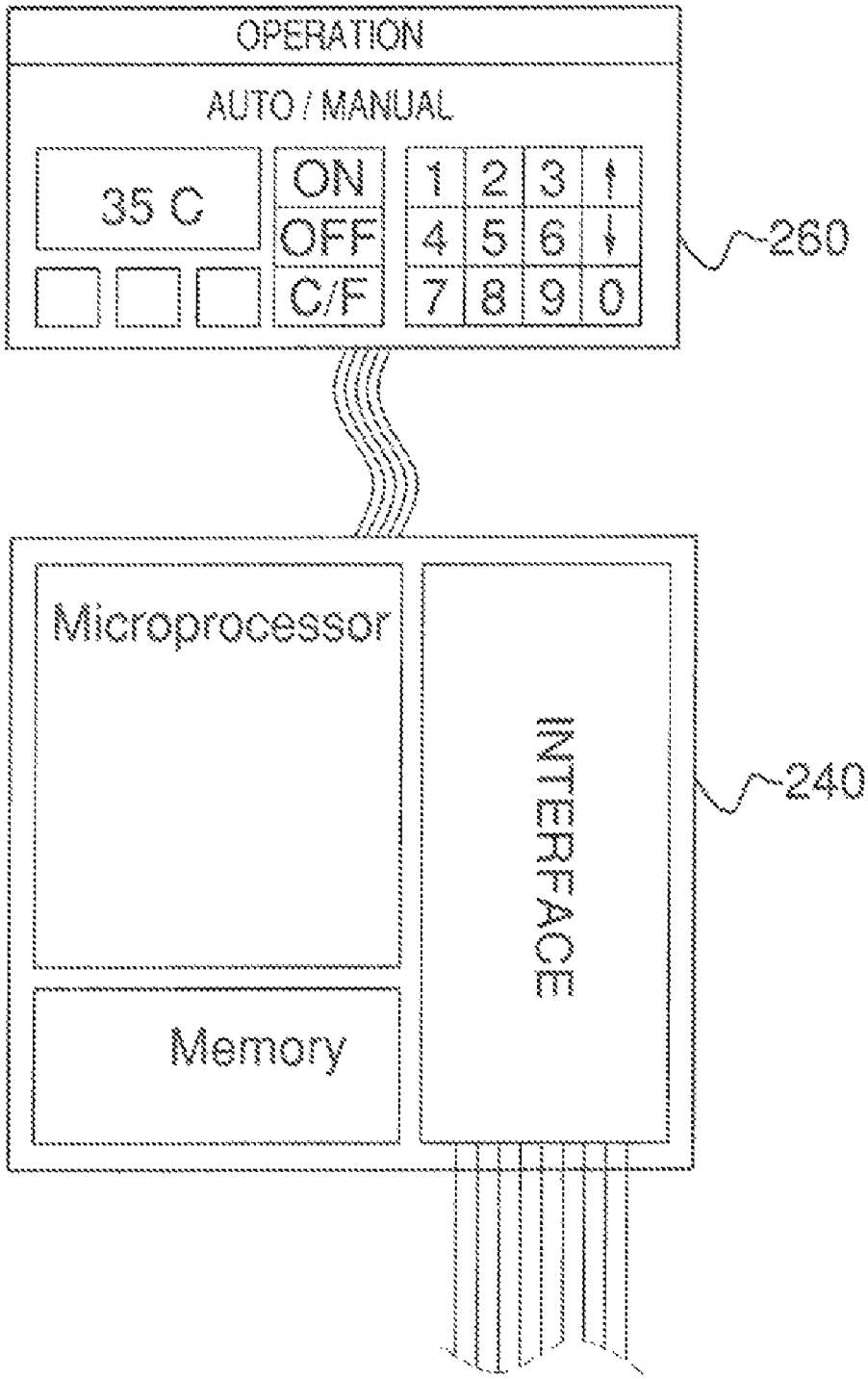
FIG. 4 is a top view of the control unit (control box) of the system of the present invention. The control unit has a means of choosing manual or automatic operation (e.g., "AUTO/MANUAL").
Figure 5:
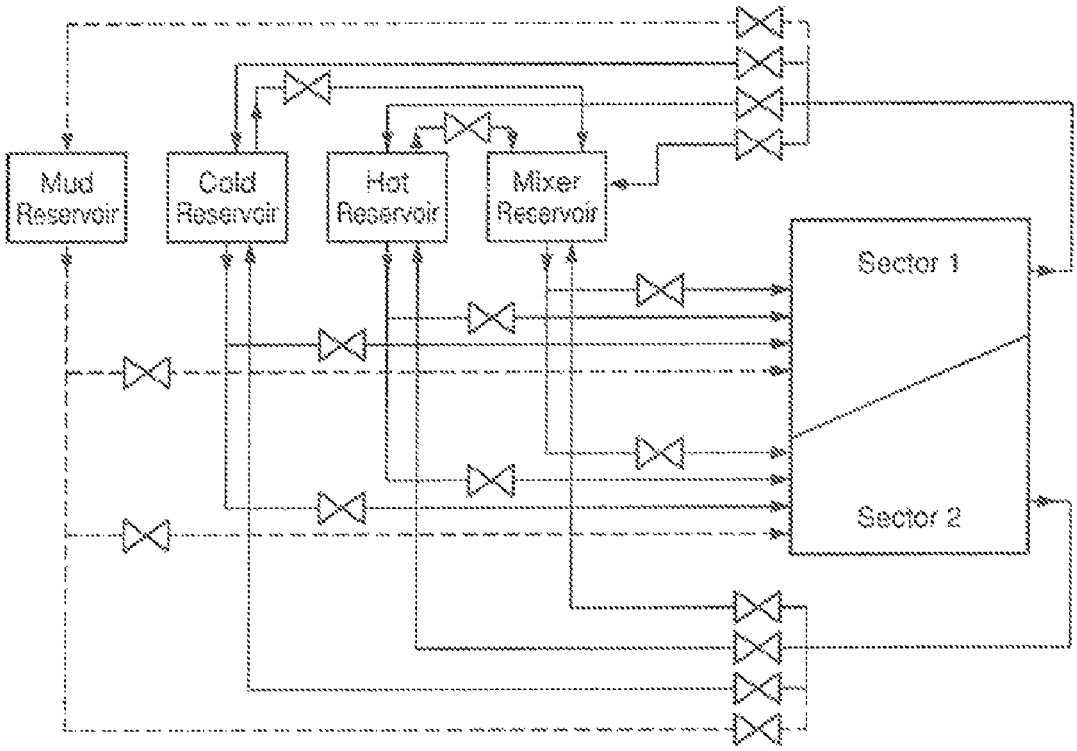
FIG. 5 is a schematic view of the system of the present invention having two sectors in the immersion tank.

Referring now to FIG. 1-6, the present invention features a spa system 100. In some embodiments, the system 100 has a dual temperature feature, allowing both hot and cold therapy to be applied at the same time. The system 100 of the present invention helps promote health in all individuals including children and adults, particularly in senior citizens. In larger units, a medical practitioner can decide on the use of a single temperature or dual temperatures by removing the separator, either manually or mechanically, which is shown in FIG. 5.

The system 100 of the present invention features in immersion tank 140 for holding a therapeutic liquid 160. The immersion tank 140 may contain a variety of different therapeutic liquids including but not limited to water (standard plain water), salt water, mud, water and mud, special herbal solutions (e.g., eucalyptus, chameleon plant, wood vinegar, bamboo vinegar, etc.), water and deodorant, and/or aromatic substances.

Figure 1:
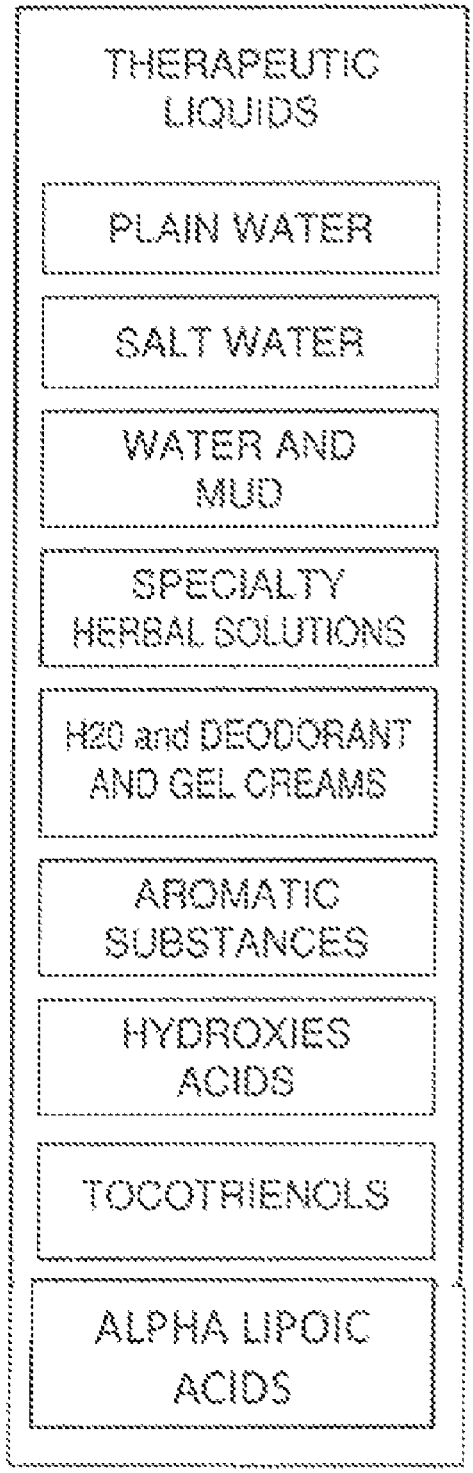
FIG. 1 is a partial list of optional liquids, semi-solids and solids that can be used with the system of the present invention (in the reservoir) for therapeutic purposes.
Figure 2A:
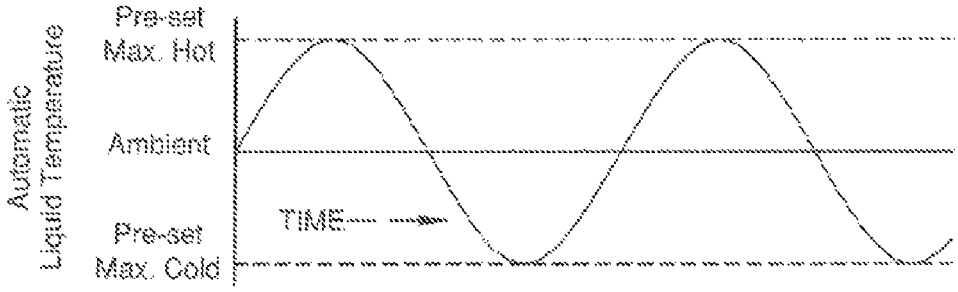
FIG. 2A is a schematic representation of the optional shifts of temperatures of the system of the present invention (if desired by the user). For example, a user can shift the temperature from hot to cold or vice versa, which can be done automatically or manually.
Figure 2B:
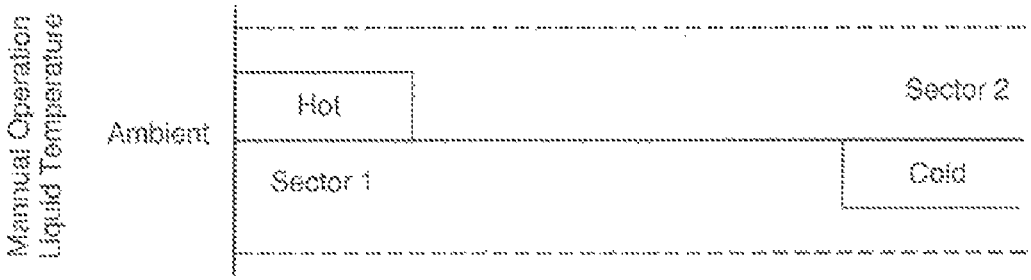
FIG. 2B is a schematic representation of examples of temperatures of the system of the present invention if the system is manually operated.
Figure 3:
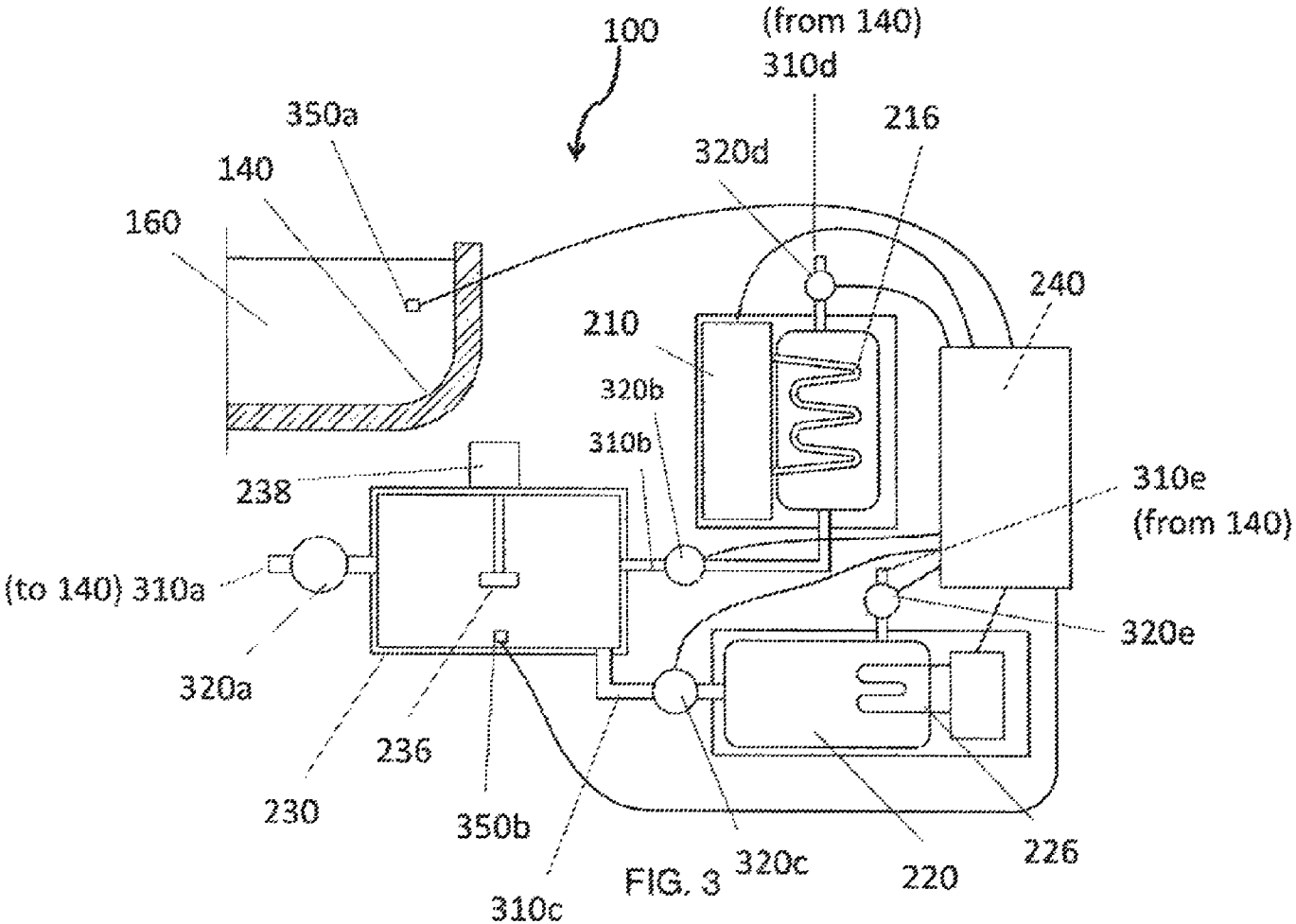
FIG. 3 is a schematic view of the system of the present invention.

As shown in FIG. 2, in some embodiments, the liquid (e.g., media) starts at ambient temperature. At pre-set or automatically determined times, by being directed to and from the cold and hot reservoirs as needed, the liquid's temperature will cycle from ambient to pre-set maximum hot to pre-set maximum cold until the cycle is terminated by the user or ends automatically by a timer. In some embodiments, hot liquid can be removed and replaced instantly with cold liquid and vice versa.

As shown in FIG. 4, in some embodiments, the immersion tank 140 has two separate sectors, a first sector and a second sector (e.g., one body part can go in the first sector and another body part can go in the second sector). The two sectors can have different temperatures independent from each other. The temperatures in the immersion tank 140 (e.g., the sectors) can change quickly. For example, the system may have multiplexing on the pipes running from the hot and/or cold reservoirs.

The system 100 further comprises a hot reservoir 220 and a cold reservoir 210 and a mixer reservoir 230. The reservoirs 210, 220, 230 each are adapted to hold the liquid (e.g., media) that ultimately is transferred to the immersion tank 140. The mixer reservoir 230 is fluidly connected to the hot reservoir 220 and the cold reservoir 210. The mixer reservoir 230 is fluidly connected to the immersion tank 140. In some embodiments, the hot reservoir 220 and the cold reservoir 210 and the mixer reservoir 230 are each fluidly connected to the immersion tank 140.

A heating element 226 is disposed in the hot reservoir 220. The heating element 226 functions to heat the liquid (e.g., media) in the hot reservoir 220. Heating elements are well known to one of ordinary skill in the art. A cooling element 216 is disposed in the cold reservoir 210. Cooling elements are well known to one of ordinary skill in the art. The cooling element 216 functions to cool the liquid (e.g., media) in the cold reservoir 210. In some embodiments, an agitator 236 is disposed in the mixer reservoir 230, which functions to mix the liquid 160 in the mixer reservoir 230 (e.g., combining hot and cold liquid to achieve a desired temperature). The agitator 236 may be operatively connected to a motor 238, which functions to drive the agitator. Agitators and motors are well known to one of ordinary skill in the art.

A first pipe 310*a* fluidly connects the immersion tank 140 to the mixer reservoir 230. A first pump 320*a* is disposed in the first pipe 310*a* functioning to deliver liquid from the mixer reservoir 230 to the immersion tank 140. A second pipe 310*b* fluidly connects the cold reservoir 210 to the mixer reservoir 230. A second pump 320*b* is disposed in the second pipe 310*b* functioning to deliver liquid from the cold reservoir 210 to the mixer reservoir 230. A third pipe 310*c* fluidly connects the hot reservoir 220 to the mixer reservoir 230. A third pump 320*c* is disposed in the third pipe 310*c* functioning to deliver liquid from the hot reservoir 220 to the mixer reservoir 230.

A fourth pipe 310*d* fluidly connects the immersion tank 140 to the cold reservoir 210. A fourth pump 320*d* is disposed in the fourth pipe 310*d* functioning to deliver liquid from the immersion tank 140 to the cold reservoir 210. A fifth pipe 310*e* fluidly connects the immersion tank 140 to the hot reservoir 220. A fifth pump 320*e* is disposed in the fifth pipe 310*e* functioning to deliver liquid from the immersion tank 140 to the hot reservoir 220.

A first temperature sensor 350*a* is disposed in the immersion tank 140, and a second temperature sensor 350*b* is disposed in the mixer reservoir 230. The temperature sensors 350 are adapted to detect temperature of the liquid (e.g., media).

The system 100 of the present invention further comprises a control unit 240. A microprocessor (with memory and interface) is housed in the control unit 240. The control unit 240 functions to change (e.g., rapidly or gradually) the temperature in the immersion tank 140 (e.g., the two sectors). The microprocessor is operatively connected to the first pump 320*a*, the second pump 320*b*, the third pump 320*c*, the fourth pump 320*d*, and the fifth pump 320*e*. The control unit 240 further comprises a programming box, which a user can use to program the temperature of the immersion tank 140 (e.g., sectors 1 and 2). Such programming boxes and programs for microprocessors are well known to one of ordinary skill in the art.

The microprocessor is operatively connected to both the first temperature sensor 350*a* and the second temperature sensor 350*b*. The temperature sensors 350 constantly relay information regarding the temperature of the tank 140 and reservoir 230 to the microprocessor. The microprocessor is adapted to store the pre-programmed temperature of the immersion tank 140. When the microprocessor detects a temperature in the immersion tank 140 that is not compliant with the pre-set temperature, the microprocessor sends output signals to the appropriate pump 320 to pump either hot or cold liquid into the mixer reservoir 230, which is then fed into the immersion tank 140.

Figure 6A:
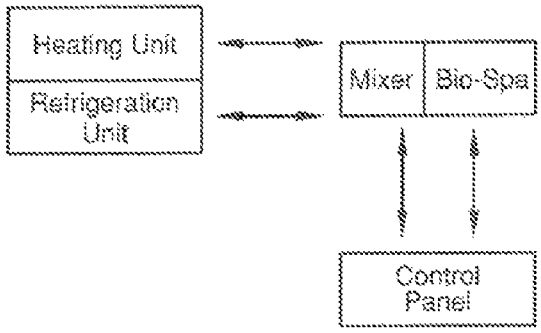
FIG. 6A is a schematic view of the system of the present invention, wherein the hot reservoir (heating unit) and cold reservoir (e.g., refrigeration unit) deliver water into the mixer reservoir, which is a part of the immersion tank ("bio spa"). The control panel functions to regulate the temperature of the immersion tank ("bio spa").
Figure 6B:
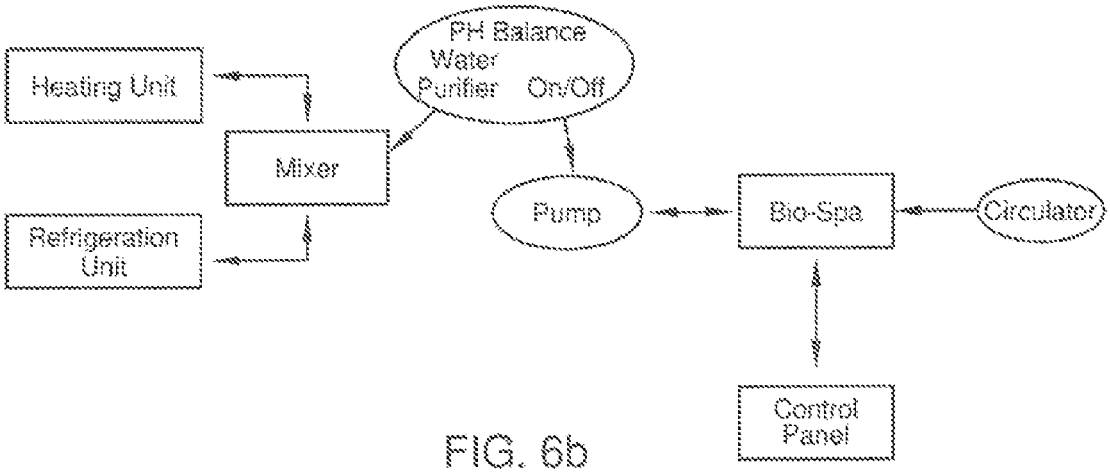
FIG. 6B is a schematic view of the system of the present invention, wherein the hot reservoir (heating unit) and cold reservoir (e.g., refrigeration unit) deliver water into the mixer reservoir, which is separate from immersion tank ("bio spa"). A pump may deliver the water from the mixer reservoir to the immersion tank ("bio spa"). In some embodiments, the control panel functions to regulate the temperature of the immersion tank ("bio spa"). Also shown in FIG. 6B are a water purifier, a pH balance system, an on/off switch for the pump, and a circulator (the circulator being operatively connected to the immersion tank ("bio spa").

The system 100 of the present invention may be constructed in a variety of configurations. For example, as shown in FIG. 64, in some embodiments, the hot reservoir 220 (heating unit) and cold reservoir 220 (e.g., refrigeration unit) deliver water into the mixer reservoir 230, which is a part of the immersion tank 140 ("bio spa"). The control panel 240 functions to regulate the temperature of the immersion tank 140 ("bio spa"). In some embodiments, as shown in FIG. 6B, the hot reservoir 220 (heating unit) and cold reservoir 210 (e.g., refrigeration unit) deliver water into the mixer reservoir 230, which separate from immersion tank 140 ("bio spa"). The control panel 240 functions to regulate the temperature of the immersion tank 140 ("bio spa").

The system of the present invention can be adapted to a large whole body unit for whole body immersion. The system can be used at a medical spa or hospital for individuals who may require drug treatment via skin transmission, where a hot/cold therapy could be used at the same time. In some embodiments, each tank section has independent massaging piston action units.

As used herein, the term "about" refers to plus or minus 10% of the referenced number. For example, an embodiment wherein the maximum temperature is about 105 degrees Fahrenheit includes a maximum temperature of between 94.5 and 115.5 degrees Fahrenheit.

The disclosures of the following U.S. Patents are incorporated in their entirety by reference herein: U.S. Pat. No. 5,241,958; U.S. Pat. No. 3,565,065; U.S. Pat. No. 6,405,390; U.S. Pat. No. 6,438,768; U.S. Pat. No. 4,217,892.

Various modifications of the invention, in addition to those described herein, will be apparent to those skilled in the art from the foregoing description. Such modifications are also intended to fall within the scope of the appended claims. Each reference cited in the present application is incorporated herein by reference in its entirety.

Although there has been shown and described the preferred embodiment of the present invention, it will be readily apparent to those skilled in the art that modifications may be made thereto which do not exceed the scope of the appended claims. Therefore, the scope of the invention is only to be limited by the following claims.

The reference numbers recited in the below claims are solely for ease of examination of this patent application, and are exemplary, and are not intended in any way to limit the scope of the claims to the particular features having the corresponding reference numbers in the drawings.

What is claimed is:

1. A spa system consisting of:

(a) an immersion tank (140) for holding a therapeutic liquid (160);

(b) a hot reservoir (220), a cold reservoir (210), and a mixer reservoir (230), the mixer reservoir (230) is fluidly connected to each the hot reservoir (220), the cold reservoir (210), and the immersion tank (140), the reservoirs (210), (220), (230) are each adapted to hold the therapeutic liquid (160);

(c) a heating element (226) disposed in the hot reservoir (220), the heating element (226) functions to heat the therapeutic liquid (160) in the hot reservoir (220);

(d) a cooling element (216) disposed in the cold reservoir (210), the cooling element (216) functions to cool the therapeutic liquid (160) in the cold reservoir (210);

(e) a first pipe (310*a*) fluidly connecting the immersion tank (140) to the mixer reservoir (230), a second pipe (310*b*) fluidly connecting the cold reservoir (210) to the mixer reservoir (230), a third pipe (310*c*) fluidly connecting the hot reservoir (220) to the mixer reservoir (230), a fourth pipe (310*d*) fluidly connecting the immersion tank (140) to the cold reservoir (210), and a fifth pipe (310*e*) fluidly connecting the immersion tank (140) to the hot reservoir (220);

(f) a first pump (320*a*) disposed in the first pipe (310*a*) functioning to deliver liquid from the mixer reservoir (230) to the immersion tank (140), a second pump (320*b*) disposed in the second pipe (310*b*) functioning to deliver liquid from the cold reservoir (210) to the mixer reservoir (230), a third pump (320*c*) disposed in the third pipe (310*c*) functioning to deliver liquid from the hot reservoir (220) to the mixer reservoir (230), a fourth pump (320*d*) disposed in the fourth pipe (310*d*) connecting the immersion tank (140) to the cold reservoir (210) functioning to deliver liquid from the immersion tank (140) to the cold reservoir (210), and a fifth pump (320*e*) disposed in the fifth pipe (310*e*) connecting the immersion tank (140) to the hot reservoir (220) functioning to deliver liquid from the immersion tank (140) to the hot reservoir (220);

(g) a first temperature sensor (350*a*) disposed in the immersion tank 140, and a second temperature sensor (350*b*) is disposed in the mixer reservoir (230), the temperature sensors (350) are adapted to detect temperature of the therapeutic liquid (160); and (h) a control unit (240) having a microprocessor, the control unit (240) functions to change temperature of the therapeutic liquid (160) in the immersion tank (140), the microprocessor is operatively connected to each the first pump (320*a*), the second pump (320*b*), the third pump (320*c*), the fourth pump (320*d*), the fifth pump (320*e*), the first temperature sensor (350*a*), and the second temperature sensor (350*b*), the temperature sensors (350) constantly relay an actual temperature of the immersion tank (140) and an actual temperature of the mixer reservoir (230) to the microprocessor, the microprocessor is adapted to store a pre-programmed temperature of the immersion tank (140) and compare the pre-programmed temperature of the immersion tank (140) to the actual temperature of the immersion tank (140), when the microprocessor detects a difference between the pre-programmed temperature and actual temperature in the immersion tank (140) the microprocessor sends an output signal to the first pump (320*a*), the second pump (320*b*), the third pump (320*c*), the fourth pump (320*d*), the fifth pump (320*e*), or a combination thereof to pump either therapeutic liquid (160) into the mixer reservoir (230) whereupon therapeutic liquid (160) from the mixer reservoir (230) is fed into the immersion tank (140) until the immersion tank (140) reaches the pre-programmed temperature.

* * * * *